United States Patent [19]

Tachikawa et al.

[11] Patent Number: 4,597,808

[45] Date of Patent: Jul. 1, 1986

[54] PROCESS FOR ION NITRIDING ALUMINUM OR ALUMINUM ALLOYS

[75] Inventors: Hideo Tachikawa, Aichi; Takatoshi Suzuki, Anjo; Hironori Fujita, Aichi; Tohru Arai, Toyoake, all of Japan

[73] Assignee: Kabushiki Kaisha Toyota Chuo Kenkyusho, Japan

[21] Appl. No.: 718,788

[22] Filed: Mar. 29, 1985

[30] Foreign Application Priority Data

Apr. 5, 1984 [JP] Japan ..... 59-68208

[51] Int. Cl.[4] ..... C21D 1/48

[52] U.S. Cl. ..... 148/20.3; 204/177

[58] Field of Search ..... 204/177; 148/20.3, 16.6

[56] References Cited

U.S. PATENT DOCUMENTS 3,140,205 7/1964 Malcolm ..... 148/16.6

4,522,660 6/1985 Suzuki et al. ..... 148/20.3

*Primary Examiner*—Christopher W. Brody

*Attorney, Agent, or Firm*—Berman, Aisenberg & Platt

[57] ABSTRACT

A process for ion nitriding aluminum or an aluminum alloy as an article to be treated, in which: the article is disposed in a sealed vessel; the oxygen gas in the vessel is removed; the surface of the article is heated to a prescribed nitriding temperature; the surface of the article is activated to facilitate the formation of an aluminum nitride layer by the subsequent nitriding treatment; and thereafter the article is subjected to ion nitriding, thereby forming an aluminum nitride layer having excellent wear resistance and high hardness. This ion nitriding treatment for aluminum material can be carried out even at temperatures lower than a solution treatment temperature of aluminum material.

18 Claims, 5 Drawing Figures

PROCESS FOR ION NITRIDING ALUMINUM OR ALUMINUM ALLOYS

BACKGROUND OF THE INVENTION

1. Field of the Invention

The present invention relates to a process for ion nitriding aluminum or aluminum alloys.

2. Description of the Prior Art

Since aluminum and aluminum alloys (hereinafter referred to as aluminum material) have low hardness and poor wear resistance, attemps have been made to develop surface treating methods for improving these properties. However, aluminum material has strong affinity to oxygen in the air and combines readily with oxygen to form a stable, dense and thin layer of alumina ($Al_2O_3$) thereon. Therefore, the surface treating method for aluminum material has limitations, as compared with surface treatment of iron or ferrous alloys, and only such surface treatment as formation of an alumina coating film by anodic oxidation has been put into practice. However, the alumina coating film merely has a Vickers hardness of about 200 to 600 (variable with the treating conditions) and thus it has not sufficient wear resistance.

On the other hand, as a coating film having higher hardness than that of the alumina coating film, there is an aluminum nitride (AlN) coating film. Aluminum nitride is useful since it is stable up to a very high temperature of 2000° C. or above and has excellent wear resistance, high thermal conductivity and good insulating properties.

Aluminum has strong affinity to nitrogen and combines readily with nitrogen to form aluminum nitride. Therefore, attempts have been made for forming aluminum nitride on the surface of aluminum material. For example, there are a melting method in which a part of aluminum material as a material to be treated is melted and nitrided, a reactive sputtering or reactive vapor deposition method, and the like. However, in the melting method, the material to be treated is deformed through melting and the obtained aluminum nitride layer has a Vickers hardness as low as 200 or less. Further, the reactive sputtering or vapor deposition method has drawbacks, such as poor adhesion between the aluminum nitride layer and the material to be treated, difficulty in treating many articles and high treating cost.

For realizing a method not using the melting method and enabling the treatment of many aluminum articles, there was an attempt to apply an ion nitriding method for treating iron or ferrous alloys to the formation of an aluminum nitride coating film having excellent wear resistance. However, such attempt has been found difficult because of an alumina layer easily formed on an aluminum article to be treated as mentioned above.

A nitriding treatment for aluminum articles of a plate-shaped or rod-shaped form has not been possible because aluminum material easily reacts with oxygen to form an alumina ($Al_2O_3$) layer thereon before nitriding as mentioned above. It has only been possible to obtain AlN powder by heating aluminum or aluminum alloy powder in a nitrogen or ammonia atmosphere. However, this method requires much expense and time. Further, it cannot be applied to direct nitriding treatment of aluminum articles having a plate-shaped or rod-shaped form.

SUMMARY OF THE INVENTION

Accordingly, it is an object of the present invention to provide a surface treating method for improving wear resistance of aluminum material.

It is another object of the present invention to provide a surface treating method for forming an aluminum nitride layer of high hardness on the surface of aluminum material.

It is a further object of the present invention to provide a process for ion nitriding aluminum material which can be effected even at low temperatures, such as its solution treatment temperature or below.

Other objects, features and advantages of the present invention will become apparent from the following description when taken in connection with the accompanying drawings.

The process for ion nitriding aluminum or an aluminum alloy according to the present invention comprises: disposing aluminum or an aluminum alloy as an article to be treated in a sealed vessel; removing residual oxygen gas in the sealed vessel; heating the surface of the article to a prescribed nitriding temperature by introducing a gas for heating into the sealed vessel and providing electric discharge; activating the surface of the article by introducing a gas activation into the sealed vessel and providing electric discharge; and in nitriding the surface of the article by introducing a gas for nitriding into the sealed vessel and allowing discharge in the vessel.

This process enables the formation of an aluminum nitride layer having high hardness and excellent wear resistance on the surface of an aluminum or aluminum alloy article.

Further, the aluminum nitride layer formed is a coating layer relatively uniform and having good adhesion.

The ion nitriding treatment according to this invention can be carried out at a temperature not exceeding the solution treatment temperature (about 550° C.) for aluminum material. Therefore, the nitriding treatment can be applied to an aluminum article without deforming the same.

BRIEF DESCRIPTION OF THE DRAWINGS

The drawings show examples of the invention.

FIG. 2 is a microphotograph (magnification x1000) showing the metallic structure of the section of the treated article and FIG. 3 is an electron probe microanalysis (EPMA) chart of aluminum and nitrogen components in the surface of the article.

DETAILED DESCRIPTION OF THE INVENTION

Figure 1:
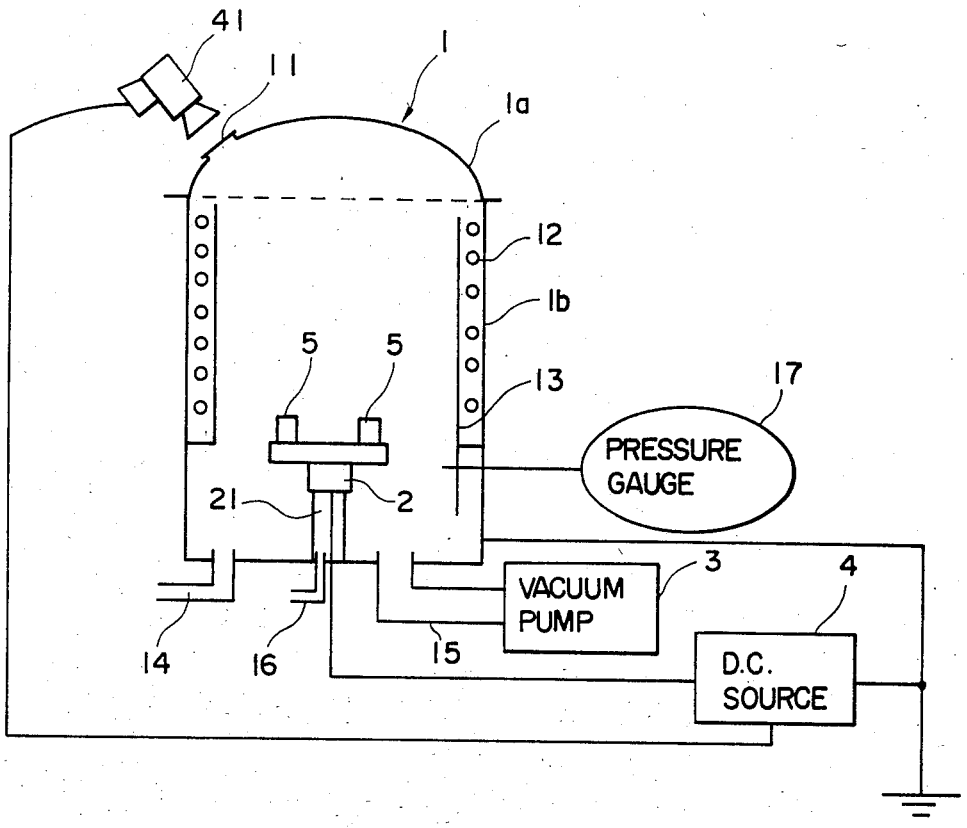
FIG. 1 is a schematic view illustrating an ion nitriding apparatus used in Example 1 according to the present invention.

In the ion nitriding process of the present invention, aluminum or an aluminum alloy as an article to be treated is disposed on a jig, such as a stand or a hanger, installed in a sealed vessel (the disposing step). Aluminum alloys to be used in this invention contain aluminum as its main component and at least one of chromium, copper, magnesium, manganese, silicon, nickel, iron, zinc or the like.

Then, the sealed vessel is closed tightly and the residual oxygen gas in the vessel is removed (the oxygen gas removing step). For removal of the residual gas, a vacuum pump, such as a rotary pump or diffusion pump, is used and the reduction in pressure and the replacement of the residual gas by an introduced gas are repeated. In this process, as a gas to be introduced, hydrogen gas, a rare gas or the like is used. It is preferred that the reduction in pressure is $10^{-3}$ Torr or less, because it becomes difficult to form an aluminum nitride layer having good adhesion when it exceeds $10^{-3}$ Torr. It is further preferred that the reduction in pressure of $10^{-5}$ Torr or less is attained by using a diffusion pump so that the layer having more excellent adhesion can be formed. In reducing the pressure, the furnace is heated by a heater installed in an inner wall of the furnace.

Next, the surface of the article is heated to a prescribed nitriding temperature by introducing a heating gas into the sealed vessel having the reduced pressure and causing discharge (the heating step). In this step, it is preferred to use hydrogen gas, nitrogen gas or a rare gas, such as helium gas, as a heating gas. These gases accelerate the heating of the article to be treated while minimizing damages of the article due to ion bombardment. Further, the heating gas is ionized by discharge and the accelerated particles collide with the surface of the article to purify the surface by removing substances consisting of organic compounds, such as carbon and oil, on the surface of the article. In this step, direct current glow discharge, alternating current glow discharge, such as high frequency discharge, or the like may be employed. The direct current glow discharge is preferred in view of low cost and a large heating capacity.

It is preferred that the pressure of a hermetically sealed vessel is from $10^{-3}$ to 10 Torr. In particular, it is preferable that the pressure is from $10^{-2}$ to 10 Torr in the case of direct current glow discharge and from $10^{-3}$ to 10−1 Torr in the case of alternating current glow discharge. That is because the discharge becomes unstable when the pressure is smaller than the above-mentioned range, and the temperature distribution of an article to be treated becomes non-uniform when the pressure is larger than the above range.

In this step, the surface temperature of an article to be treated is heated to a nitriding temperature. However, if the temperature is also raised in the subsequent activating step, the surface of the article may be heated to the nitriding temperature minus a temperature rise in the subsequent step.

Then, the surface of the article to be treated is activated by introducing an activating gas into the sealed vessel and causing discharge (the activating step). This step is a pretreatment for promoting the reaction velocity in the subsequent nitriding treatment. Namely, it is carried out in a manner to activate the surface of the article so that aluminum nitride is formed readily in the nitriding treatment. In this step, substances which are still existing on the surface of the article to be treated as a barrier restraining nitriding are removed or changed in quality into a state where they do not obstruct the nitriding. Such substances include aluminum oxide ($Al_2O_3$) and substances adhering to the surface of the article, such as organic substances, which cannot be removed even by the purifying action in the heating step. Of these substances, aluminum oxide ($Al_2O_3$) is formed readily as a stable, dense and thin (several tens of A) film layer on the surface of the article even when the article is left at room temperature, because aluminum has high affinity to oxygen and the both combine with each other easily. Since the alumina layer cannot be sufficiently removed in the heating step, it is reduced, removed, or changed in quality by ion bombardment of activating gas in this activating step, thereby to activate the surface of the article to be treated.

The activating gas for use in this step may be one or more rare gases of helium (He), neon (Ne), argon (Ar), krypton (Kr), xenon (Xe) and radon (Rn). The use of these rare gases enables high activation of the surface to be treated with efficiency.

Usually, in the activating step, direct current glow discharge or alternating current glow discharge, such as high frequency discharge, is employed, but ion beam sputtering may be employed. Of these, direct current glow discharge is preferred in view of low cost, efficiency in the removal of nitriding restraining substances and a large heating capacity.

The sealed vessel preferably has a pressure of from 10−3 to 5 Torr. In particular, it is preferred that the pressure of the vessel is from $10^{-2}$ to 5 Torr with direct current glow discharge and from 10−3 to $10^{-1}$ Torr with alternating current glow discharge. That is because the discharge becomes unstable with the smaller pressure due to arc generation or the like and a smaller amount of nitriding restraining substance can be removed with the larger.

In carrying out the activation step, a heating gas is changed to an activating gas with the discharge continued. However, another method may be adopted, in which the discharge is once interrupted simultaneously with stopping the introduction of a heating gas, the heating gas is removed, and then an activating gas is introduced into the vessel to a prescribed pressure to restract the discharge.

The surface of an article to be treated may further be heated in this step where necessary.

Further, the activating step as a pretreatment for the subsequent ion nitriding step may be carried out before the above-mentioned heating step. However, if the heating step takes a long time, the effect of the activating step will be lowered. That is because an alumina layer is formed on the surface of the article to be treated due to a very small amount of residual oxygen in the sealed vessel and a very small amount of oxygen or oxidizing gas in the atmosphere (a heating gas) during the heating step.

Then, an ion nitriding step is preformed by introducing a nitriding gas into the vessel and generating glow discharge in the vessel (the ion nitriding step).

As a nitriding gas for use in the ion nitriding step, nitrogen ($N_2$) or a gas with a nitrogen base, e.g., ammonia ($NH_3$) or a mixed gas of nitrogen ($N_2$) and hydrogen ($H_2$) is used. When the mixed gas is used, it is preferred that the mixed gas has a high content of nitrogen. That is because the use of high purity nitrogen contributes to a rapid formation of aluminum nitride and obviates disadvantages, such as corrosion of an inner surface of a sealed vessel.

Further, as the glow discharge, direct current or alternating current glow discharge is used.

It is preferred that the pressure of the vessel is from 10−1 to 20 Torr. The formation speed of aluminum nitride, i.e. the nitriding speed is low under the lower pressure and the glow discharge becomes unstable under the higher pressure.

A treating temperature in the ion nitriding step is preferably set to be in the range of from 300° C. to 500° C. The nitriding speed is low with the treating temperature less than 300° C., and melting and deformation (e.g. change in dimensions and generation of distortion) of an article to be treated is caused with the treating temperature exceeding 500° C. Further, under higher temperatures, spalling of an aluminum nitride layer is apt to occur during cooling. It is more preferred that the treating temperature is from 450° C. to 520° C.

DESCRIPTION OF THE PREFERRED EMBODIMENTS

Examples of the invention are described hereinafter.

EXAMPLE 1

An aluminum nitride layer was formed on an aluminum article by ion nitriding according to the invention and the thickness of the aluminum nitride layer was measured.

In this Example, the ion nitriding apparatus shown in FIG. 1 was used. The apparatus comprises, as its main components, a hermetically sealed vessel 1 of stainless steel and a holder 2 installed at the middle of the vessel. The sealed vessel 1 is composed of a lid 1*a* and a reaction furnace 1*b*, the former having a window 11 and the latter a preheating heater 12 on its inner side surface. Further, a stainless steel anode plate 13 is installed on the inner side of the heater 12. The bottom part of the sealed vessel 1 is provided with a gas introducing pipe 14, a gas exhausting pipe 15, a supporting pillar 21 for the holder 2, a cooling water pipe 16 for feeding cooling water to the pillar 21 and a mercury manometer 17.

The gas introducing pipe 14 is connected through control valves to a high purity nitriding gas bomb and a high purity hydrogen gas bomb (both are not shown). Further, a vacuum pump 3 is connected to the gas exhausting pipe 15.

A direct current circuit 4 as the cathode is formed between the anode 13 and the holder 2. The current of the direct current circuit 4 is controlled by an input from a dichromatic thermometer 41 for measuring the temperature of articles to be treated so that the current circuit 4 functions to maintain the temperature of articles within a given range.

In this Example, two industrial pure aluminum plates (discs having aluminum content of over 99.5%, an outer diameter of 19 mm and a thickness of 10 mm) were used as articles to be treated and they were disposed on the holder 2, as shown in FIG. 1.

For ion nitriding wih the apparatus, articles to be treated were disposed on the holder, and the sealed vessel was tightly closed. Then, the vessel was reduced in pressure by the vacuum pump up to the residual gas pressure of $10^{-3}$ Torr. Thereafter, the furnace wall was heated with the preheating heater for 30 minutes while the residual gas was being sucked by the vacuum pump. Immediately after the heating, hydrogen gas was introduced into the sealed vessel until the pressure of 4 Torr was reached to replace the residual gas with hydrogen, and then the gas pressure in the vessel was reduced to $10^{-3}$ Torr again. Such replacement with hydrogen gas was repeated two or three times so as to remove the residual gas in the furnace as much as possible.

Then, hydrogen gas was allowed to flow through the furnace having the reduced pressure of $10^{-3}$ Torr while the gas in the furnace was being sucked by a vacuum pump so that the pressure in the furnace was maintained to be 1.3 Torr. Then, direct current voltage of several hundred volts was applied across the two electrodes 13 and 2 to start electric discharge and to heat articles to be treated by ion bombardment. When the surface of each article was heated up to 500° C., the flow of hydrogen gas was stopped and subsequently argon gas was introduced. The introduction of argon gas was controlled so as to have the argon gas pressure of 1 Torr in the furnace and then the discharge was continued further for 2 hours with the argon gas pressure maintained at 1 Torr. In another method, electric discharge is interrupted simultaneously with stopping the flow of hydrogen gas and then the residual hydrogen gas is removed, followed by the introduction of argon gas to restart the discharge.

Sputtering for treating the articles by the discharge in the argon gas atmosphere was carried out at 500° C. for 2 hours. Then, the introduction of argon gas was stopped and nitrogen gas was introduced into the furnace. The flow of nitrogen gas was controlled to maintain the nitrogen gas pressure in the furnace at 3.5 Torr, and, after the temprature of article to be treated was set at a prescribed nitriding temperature as shown in Table 1, ion nitriding of the articles was carried out for 5 hours maintaining the nitriding temperature. It is preferable to continue the discharge when argon gas is changed over to nitrogen gas.

After the nitriding treatment, the discharge was ceased and the articles were allowed to cool under reduced pressure of about $10^{-3}$ Torr. After the articles were cooled to below 50° C., they were taken out of the furnace. The thus treated articles had black layers formed thereon.

Each black layer obtained was tested for material identification by a X-ray diffraction method and, as a result, every layer was confirmed to be aluminum nitride (AlN) of wurtzite type.

TABLE 1

| Test No. | Activation process Gas for activation | Nitriding temp. (°C.) | Layer thickness (μm) | Hardness of matrix (kg/mm²) | Surface hardness including nitrided layer (kg/mm²) |
|---|---|---|---|---|---|
| 1 | Ar | 300 | 0.2 | 45 | 55 |
| 2 | " | 350 | 0.5 | 39 | 60 |
| 3 | " | 400 | 0.8 | 37 | 73 |
| 4 | " | 450 | 1.8 | 32 | 102 |
| 5 | " | 475 | 2.5 | 29 | 265 |
| 6 | " | 500 | 3.0 | 27 | 360 |
| 7 | " | 525 | 5.1 | 27 | 700 |
| 8 | " | 550 | 7.5 | 26 | 1200 |
| 9 | " | 600 | Spalling | 24 | Unmeasurable |
| 10 | " | 650 | Spalling | 23 | " |
| $C_1$ | $H_2$ | 400 | No nitriding | 36 | — |
| $C_2$ | " | 550 | No nitriding | 25 | — |
| $C_3$ | " | 600 | No nitriding | 24 | — |

Figure 2:
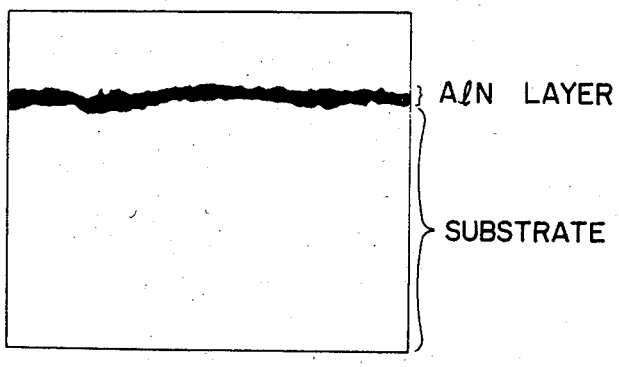
FIGS. 2 and 3 relate to the layer formed on an aluminum or aluminum alloy article treated in Example 1.
Figure 3:
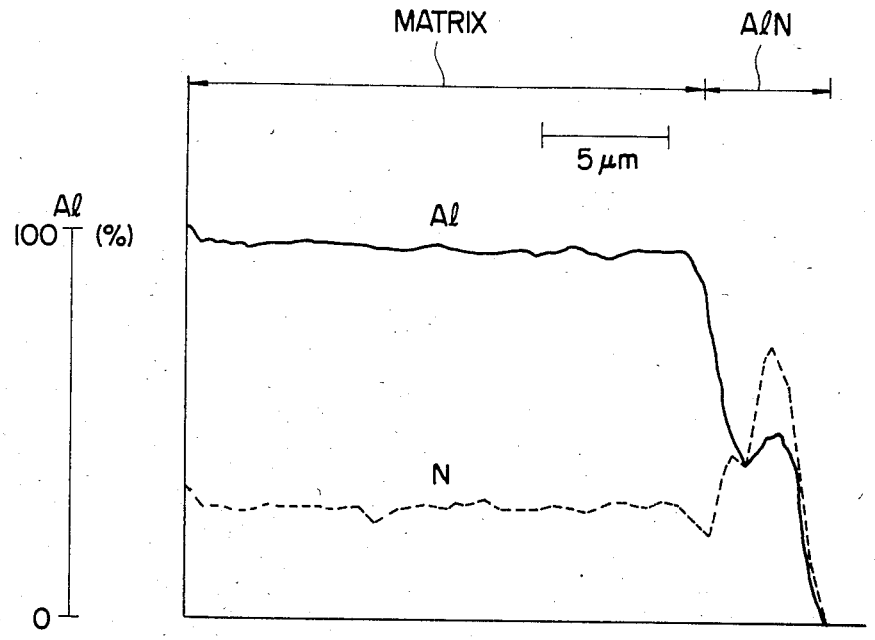

Then, the thickness of black layers formed on the surface of the articles and the surface hardness of the same were measured. The results are shown in Table 1. The specimen of Test No. 6 treated at a nitriding temperature of 500° C. was cut and a microphotograph (magnification x 1000) of FIG. 2 shows its section. In addition, the elemental analysis of the section was carried out by an EPMA method and the result is shown in FIG. 3. The surface layer was confirmed to be a hard aluminum nitride layer by these tests.

Further, for comparison, ion nitriding treatment tests were carried out by the same method as the above-mentioned except the use of hydrogen gas as the activating gas in the activation process (Test Nos. $C_1$–$C_3$). As a result, articles of Test Nos. $C_1$–$C_3$ were not nitrided.

EXAMPLE 2

Industrial pure aluminum plates (disks having aluminum content of over 99.5%, a outer diameter of 19 mm and thickness of 10 mm) were treated using the ion nitriding apparatus used in Example 1.

The nitriding treatment for the articles to be treated in Example 2 was similar to that in Example 1. Therefore, differences between the two are described.

In Example 2, as the activating gas in the activation process, helium (He) gas, neon (Ne) gas or argon (Ar) gas was used. The pressure of these introduced gases was each 0.1 Torr, and sputtering was carried out at 500° C. for 1 hour under an atmosphere of the introduced gas.

Further, the ion nitriding in the ion nitriding step was carried out at 500° C. for 5 hours.

Thus, a black layer was formed on the surface of each article treated.

Each black layer obtained was tested for material identification by X-ray diffraction analysis and, as a result, every layer was confirmed to be aluminum nitride (AlN). Further, the aluminum nitride layer was measured for thickness. The results are shown in Table 2.

TABLE 2

| Test No. | Activation process Gas for activation | Layer thickness (μm) |
|---|---|---|
| 11 | He | 2.1 |
| 12 | Ne | 2.5 |
| 13 | Ar | 3.2 |

EXAMPLE 3

Disk-shaped members having an outer diameter of 19 mm and a thickness of 10 mm made of industrial aluminum alloys JIS (Japanese Industrial Standards) 2017 (Test No. 14) and JIS 6061 (Test No. 15) were used as articles to be treated.

The ion nitriding treatment in Example 3 was similar to that in Example 1. Therefore, differences between the two are described.

In this Example, argon (Ar) gas was employed as an activating gas, the pressure of the introduced gas was set to be 0.6 Torr, and sputtering for the surfaces of articles was carried out by the discharge in an atmosphere of the introduced gas at 500° C. for 1 hour.

As a nitriding gas for use in the ion nitriding step, ammonia ($NH_3$) gas and a mixed gas of nitrogen ($N_2$) and hydrogen ($H_2$) were each used, and the nitriding was carried out under treating conditions as shown in Table 3.

Thus, a black layer of aluminum nitride (AlN) was formed on the surface of each article. The thickness of aluminum nitride layers thus obtained was measured. The results are shown in Table 3.

TABLE 3

| Test No. | Nitriding-treating conditions: Nitriding gas | Gas pressure (Torr) | Treatment temp. (°C.) × time (hr) | Layer thickness (μm) |
|---|---|---|---|---|
| 14 | $NH_3$ | 3.5 | 520 × 10 | 2.0 |
| 15 | $10N_2 + H_2$ | 3.5 | 520 × 6 | 1.5 |

EXAMPLE 4

Two types of aluminum alloys in practical use were used as articles to be subjected to ion nitriding and aluminum nitride layers thus formed were measured for thickness and tested for wear resistance.

The ion nitriding process and apparatus used in this Example were similar to those used in Example 1. Therefore, differences between the both are described in detail.

As articles to be treated, ring-shaped specimens having an outer diameter of 20 mm, an inner diameter of 10 mm and a thickness of 10 mm made of a practically used aluminum alloy (duralmin JIS 2017: Test No. 16) and of a practically used Al-Si alloy [AA(Aluminum association) A390: Test No. 17] were used.

Argon (Ar) gas was used as the activating has in this activation treatment. The introduced gas pressure in the activation treatment was 0.6 Torr and sputtering for the surfaces of articles to be treated was carried out by the discharge in an atmosphere of the introduced gas at 500° C. for 0.5 hour for Test No. 16 and for 1 hour for Test No. 17.

Nitrogen ($N_2$) gas was used as the nitriding gas in the ion nitriding step and the nitriding was carried out under treating conditions as shown in Table 4.

Thus, a black aluminum nitride layer was formed on the surface of each article. The thickness of aluminum nitride layers thus obtained was measured. The results are shown in Table 4.

TABLE 4

| Test No. | Ion nitriding treatment condition: Gas pressure (Torr) | Nitriding temp. (°C.) | Treating time (hr) | Layer thickness (μm) |
|---|---|---|---|---|
| 16 | 3.5 | 500 | 5.0 | 3.0 |
| 17 | 2.0 | 450 | 5.0 | 2.0 |

Figure 4:
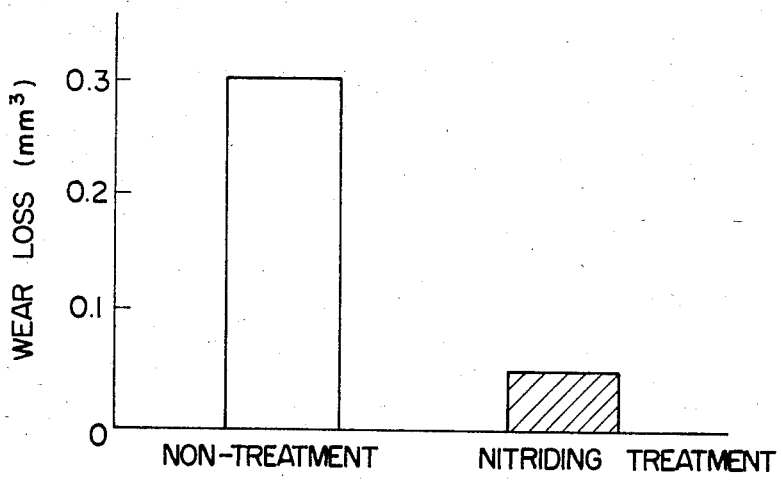
FIGS. 4 and 5 relate to the aluminum nitride layer of articles treated in Example 4 showing wear loss of the treated articles.
Figure 5:
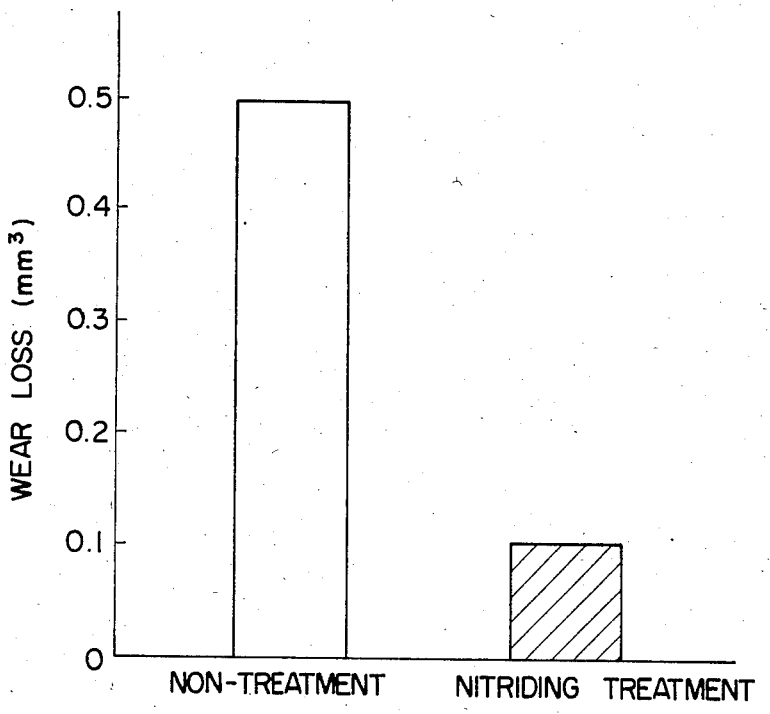

Further, the articles subjected to ion nitriding treatment were tested for wear resistance. For comparison, non-treated specimens having the same quality and dimensions as those of the treated articles were similarly tested for wear resistance. The results are shown in FIG. 4 for the specimen of Test No. 16 and in FIG. 5 for the specimen of Test No. 17. As shown in these Figures, the both specimens of Test Nos. 16 and 17 show the wear amount of 1/5 or less as compared with the corresponding non-treated ones, and the aluminum nitriding proves to be effective to wear resistance.

Then, the article (Test No. 16) subjected to ion nitriding was tested for oxidation to examine the wear resistance property. The oxidation test was carried out by heating the article in an atmosphere at 500° C. for 20 hours, and the same wear resistance test as in the above Example was carried out. As a result, the treated article subjected to the oxidation test only had the wear loss of 0.05 $mm^3$ and thus showed the similar wear resistance to that of the article not subjected to the oxidation test.

Therefore, it was confirmed that the aluminum nitride layer was not deteriorated by oxidation.

EXAMPLE 5

Industrial pure aluminum and industrial aluminum alloys were used as articles to be subjected to ion nitriding, and the measurement of the thickness of the aluminum nitride layers formed and the hardness test for sections including such layers were carried out.

The ion nitriding process and apparatus used in this Example were similar to those in Example 1. Therefore, differences between the both are described in detail.

Disk-shaped members having an outer diameter of 19 mm and a thickness of 10 mm (Test Nos. 18–22) which were made of aluminum and aluminum alloys as shown in Table 5 were used as the articles to be treated.

In the activation treatment, argon gas was introduced into the furnace, the flow of argon gas was controlled to set the argon gas pressure at 0.6 Torr, and then sputtering was carried out by the discharge at 500° C. for 1 hour.

In the ion nitriding treatment, nitrogen gas was introduced into the furnace, the flow of nitrogen gas was controlled to set the nitrogen gas pressure at 5 Torr, and then the ion nitriding was carried at 475° C. for 10 hours.

Thus, a black aluminum nitride (AlN) layer was formed on the surface of each article. The thickness of aluminum nitride layers thus obtained was measured. The results are shown in Table 5. The section of each treated article was polished obliquely to measure the sectional hardness. The results are also shown in Table 5. As a result of the sectional hardness test, all treated articles showed a hardness of above Hv 2000.

TABLE 5

| Test No. | Material to be treated (JIS) | Layer thickness (μm) | Surface hardness (Hv) |
|---|---|---|---|
| 18 | 1050 | 4.0 | 2150 |
| 19 | 2017 | 5.0 | 2050 |
| 20 | 5052 | 6.0 | 2300 |
| 21 | 6061 | 3.2 | 2100 |
| 22 | 7072 | 3.5 | 2050 |

What is claimed is:

1. A process for ion nitriding an article of aluminum or of aluminum alloy, comprising the steps of disposing the article in a sealed vessel;

removing residual oxygen gas from the vessel;

heating the surface of said article to a prescribed nitriding temperature by introducing a heating gas into said vessel and by applying a voltage to start an electro discharge therein;

activating the surface of said article by introducing an activating gas into said vessel and subjecting the surface to sputtering; and ion nitriding the surface of said article by introducing a nitriding gas into said vessel and applying a voltage to start an electro discharge therein, thereby forming an aluminum nitride layer having high hardness and wear resistance.

2. A process according to claim 1, wherein said activating gas is at least one rare gas selected from the group consisting of helium, neon, argon, krypton, xenon and radon.

3. A process according to claim 2, wherein said sputtering in the activating step is caused by direct current glow discharge, alternating current glow discharge or ion beam.

4. A process according to claim 3, wherein said vessel has a pressure during the activating step in the range of from $10^{-3}$ to 5 Torr.

5. A process according to claim 2, wherein said nitriding gas is selected from nitrogen gas, ammonia gas and a mixed gas of nitrogen and hydrogen.

6. A process according to claim 5, wherein said electro discharge in the ion nitriding step is direct current glow discharge or alternating current glow discharge.

7. A process according to claim 6, wherein the pressure in said vessel in the ion nitriding step is in the range of from $10^{-1}$ to 20 Torr.

8. A process according to claim 1, wherein the ion nitriding step is carried out at a temperature ranging from 300° to 550° C.

9. A process according to claim 1, wherein said residual oxygen gas is removed by repeating a series of the reduction of pressure in said vessel and the subsequent replacement of the residual oxygen gas by a gas introduced therein, and said ion nitriding step is carried out at a temperature ranging from 300° to 550° C.

10. A process according to claim 9, wherein said reduction of pressure is carried out by a vacuum pump selected from a rotary pump and a combination of a rotary pump and a diffusion pump.

11. A process according to claim 10, wherein said introduced gas in the removing step is hydrogen gas or a rare gas, and said ion nitriding step is carried out at a temperature ranging from 300° to 550° C.

12. A process according to claim 11, wherein the pressure in said vessel in the removing step is reduced to a pressure of not more than $10^{-3}$ Torr.

13. A process according to claim 2, wherein said heating gas in the heating step is hydrogen gas, nitrogen gas or a rare gas, and said ion nitriding step is carried out at a temperature ranging from 300° to 550° C.

14. A process according to claim 13, wherein said electro discharge in the heating step is direct current glow discharge or alternating current glow discharge.

15. A process according to claim 14, wherein the pressure in said vessel in the heating step is in the range of from $10^{-3}$ to 10 Torr.

16. A process according to claim 7, wherein said activating gas is argon or helium, said sputtering in the activating step is caused by direct current glow discharge, and the pressure in said vessel in the activating step is in the range of from 0.1 to 5 Torr.

17. A process according to claim 16, wherein said nitriding gas is nitrogen gas, said electro discharge in the nitriding step is direct current glow discharge, and the pressure in said vessel in the nitriding step is in the range of from 0.1 to 10 Torr.

18. A process according to claim 17, wherein said residual oxygen gas is removed by repeating a series of the reduction of pressure in said vessel by a rotary pump and a diffusion pump and the subsequent replacement of residual oxygen gas by a gas introduced therein until the pressure in said vessel is reduced to a pressure of under $10^{-3}$ Torr, said heating gas in the heating step is argon or helium, said electro discharge in the heating step is direct current glow discharge, the pressure in said vessel in the heating step is in the range of from 0.1 to 5 Torr, and the ion nitriding step is carried out at a temperature ranging from 450° to 520° C.

* * * * *